US010597943B2

(12) United States Patent
Wheeler et al.

(10) Patent No.: US 10,597,943 B2
(45) Date of Patent: Mar. 24, 2020

(54) DRILLING SYSTEM INCLUDING A DRIVESHAFT/HOUSING LOCK

(71) Applicant: Halliburton Energy Services, Inc., Houston, TX (US)

(72) Inventors: Fraser A. Wheeler, Edmonton (CA); Geoffrey Andrew Samuel, Edmonton (CA)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 15/770,841

(22) PCT Filed: Aug. 3, 2016

(86) PCT No.: PCT/US2016/045364
§ 371 (c)(1),
(2) Date: Apr. 25, 2018

(87) PCT Pub. No.: WO2018/026365
PCT Pub. Date: Feb. 8, 2018

(65) Prior Publication Data

US 2019/0145174 A1 May 16, 2019

(51) Int. Cl.

| | |
|---|---|
| ***E21B 7/06*** | (2006.01) |
| *E21B 7/04* | (2006.01) |
| *E21B 17/06* | (2006.01) |
| *E21B 31/00* | (2006.01) |

(Continued)

(52) U.S. Cl.
CPC ..... *E21B 7/067* (2013.01); *E21B 7/062* (2013.01); *E21B 7/04* (2013.01); *E21B 7/064* (2013.01); *E21B 7/10* (2013.01); *E21B 17/06* (2013.01); *E21B 17/1057* (2013.01); *E21B 31/00* (2013.01)

(58) Field of Classification Search
CPC ..... E21B 7/067; E21B 7/062
See application file for complete search history.

(56) References Cited

U.S. PATENT DOCUMENTS

| | | | |
|---|---|---|---|
| 4,299,296 | A | 11/1981 | Geczy |
| 5,269,385 | A | 12/1993 | Sihlis |
| 6,244,361 | B1 | 6/2001 | Comeau et al. |

(Continued)

FOREIGN PATENT DOCUMENTS

| | | | |
|---|---|---|---|
| WO | 2016043752 | A1 | 3/2016 |
| WO | 2018026365 | A1 | 2/2018 |

*Primary Examiner* — Kristyn A Hall
(74) *Attorney, Agent, or Firm* — Alan Bryson; Parker Justiss, P.C.

(57) ABSTRACT

The present disclosure provides a drilling system, and a method of operating a downhole tool. The drilling system, in one embodiment, includes a housing defining a first longitudinal dimension, a driveshaft positioned within the housing and defining a second longitudinal dimension. In this embodiment, the housing and driveshaft are operable to slide relative to one another along the first longitudinal dimension and the second longitudinal dimension, and rotate relative to one another. The drilling system, in accordance with this embodiment, further includes a load sensor operable to sense the housing and driveshaft sliding relative to one another, and a locking mechanism operable to lock or unlock the relative rotation of the housing and the driveshaft in response to the load sensor sensing the housing and driveshaft sliding relative to one another thereto.

20 Claims, 8 Drawing Sheets

(51) Int. Cl.
*E21B 7/10* (2006.01)
*E21B 17/10* (2006.01)

(56) References Cited

U.S. PATENT DOCUMENTS

| | | | | |
|---|---|---|---|---|
| 7,234,544 | B2 | 6/2007 | Kent | |
| 7,306,058 | B2 | 12/2007 | Cargill et al. | |
| 2004/0144567 | A1 | 7/2004 | Boyd | |
| 2012/0261528 | A1* | 10/2012 | Stoldt ..... | E21B 19/06 248/68.1 |
| 2014/0231144 | A1 | 8/2014 | Sonar et al. | |

* cited by examiner

DRILLING SYSTEM INCLUDING A DRIVESHAFT/HOUSING LOCK

CROSS-REFERENCE TO RELATED APPLICATION

This application is the National Stage of, and therefore claims the benefit of, International Application No. PCT/US2016/045364 filed on Aug. 3, 2016, entitled "A DRILLING SYSTEM INCLUDING A DRIVESHAFT/HOUSING LOCK" which was published in English under International Publication Number WO 2018/026365 on Feb. 8, 2018. The above application is commonly assigned with this National Stage application and is incorporated herein by reference in its entirety.

TECHNICAL FIELD

This application is directed, in general, to directional drilling systems and, more specifically, to rotary steerable downhole tools.

BACKGROUND

In the oil and gas industry, rotary steerable tools for downhole operations can be used to drill into a formation along a desired path that can change in direction as the tool advances into the formation. Such tools can employ components that brace against the formation to provide a reaction torque to prevent rotation of non-rotating tool portions used as a geostationary reference in steering the rotating portions of the tool.

Such conventional methods and systems have generally been considered satisfactory for their intended purpose. However, there is still a need in the art for improved steerable rotary tools. The present disclosure provides a solution for this need.

BRIEF DESCRIPTION

Reference is now made to the following descriptions taken in conjunction with the accompanying drawings, in which.

DETAILED DESCRIPTION

Many oil/gas downhole drilling tools require a non-rotating outer housing as a geostationary reference to maintain steering control while drilling. The present disclosure includes systems and methods that enable the housing to be selectively rotated while tripping out of or tripping into the borehole. For example, in the event that the drilling tool were to get stuck while tripping out of or tripping into the borehole, the present disclosure teaches how to selectively lock the rotation of the housing with the driveshaft, and thus transfer the torque from the driveshaft to the housing to ideally free the drilling tool. Selectively locking in this context can include the ability to repeatedly lock and unlock the relative rotation of the housing and the driveshaft. As taught below, this may desirably avoid the need for replacement or physical resetting of the locking mechanism.

Figure 1:
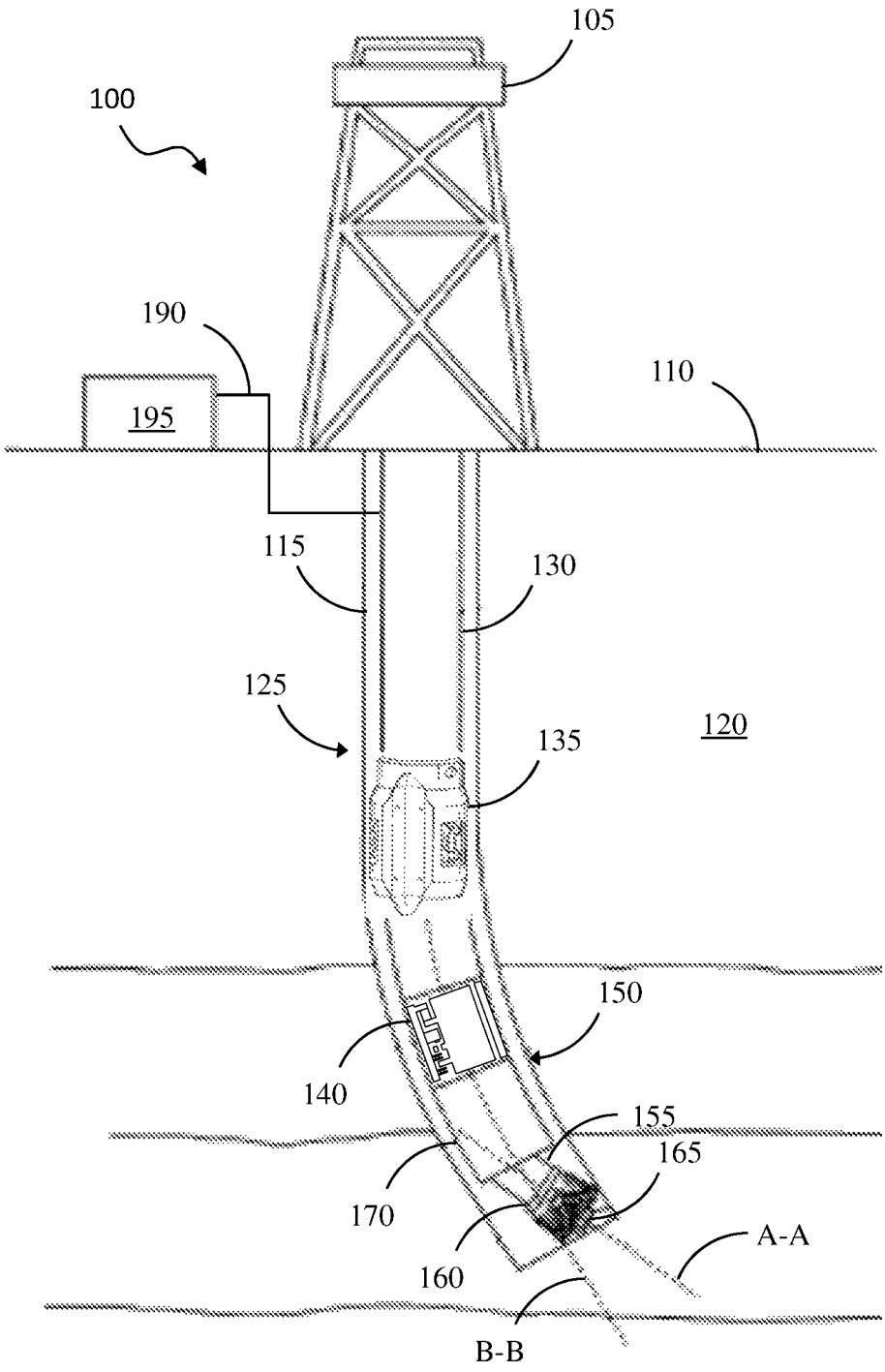
FIG. 1 illustrates an elevation view of an example drilling system according to aspects of the present disclosure.

Reference will now be made to the drawings wherein like reference numerals identify similar structural features or aspects of the subject disclosure. For purposes of explanation and illustration, and not limitation, FIG. 1 illustrates a sectional view of an example drilling system 100 according to aspects of the present disclosure. The drilling system 100 includes a rig 105 mounted at the surface 110 and positioned above borehole 115 within a subterranean formation 120. In the embodiment shown, a drilling assembly 125 may be positioned within the borehole 115 and may be coupled to the rig 105. The drilling assembly 125 may comprise drillstring 130, anti-rotation system 135, and driveshaft/housing lock system 140 among other items. The drillstring 130 may comprise a plurality of segments threadedly connected to one another.

The drilling assembly 125 may further include a bottom hole assembly (BHA) 150. The BHA 150 may comprise a steering assembly, with an internal driveshaft 155 and a drill bit 160 coupled to a lower end of the BHA 150. The steering assembly 170 may control the direction in which the borehole 115 is being drilled. The borehole 115 will typically be drilled in the direction perpendicular to a tool face 165 of the drill bit 160, which corresponds to the longitudinal axis A-A of the drill bit 160. Accordingly, controlling the direction in which the borehole 115 is drilled may include controlling the angle of the longitudinal axis A-A of the drill bit 160 relative to the longitudinal axis B-B of the steering assembly 170, and controlling the angular orientation of the drill bit 160 with respect to the steering assembly 170. Furthermore, the anti-rotation system 135 provides a geostationary reference point for the steering assembly 170.

The drilling system 100 may additionally include any suitable wired drillpipe, coiled tubing (wired and unwired), e.g., accommodating a wireline 190 for control of the driveshaft/housing lock system 140 and the steering assembly 170 from the surface 110 during downhole operation. It is also contemplated that the drilling system 100 as described herein can be used in conjunction with a measurement-while-drilling (MWD) apparatus, which may be incorporated into the drillstring 130 for insertion in the borehole 115 as part of a MWD system. In a MWD system, sensors associated with the MWD apparatus provide data to the MWD apparatus for communicating up the drillstring 130 to an operator of the drilling system 100. These sensors typically provide directional information of the drillstring 130 so that the operator can monitor the orientation of the drillstring 130 in response to data received from the MWD apparatus and adjust the orientation of the drillstring 130 in response to such data. An MWD system also typically enables the communication of data from the operator of the system down the borehole 115 to the MWD apparatus. Systems and methods as disclosed herein can also be used in conjunction with logging-while-drilling (LWD) systems, which log data from sensors similar to those used in MWD systems as described herein. In FIG. 1, the MWD/LWD system 195 is shown connected to drillstring 130 by wireline 190.

In operation, the drilling assembly 125 may be advanced downhole through the borehole 115 in the formation 120. In accordance with the disclosure, as the drilling assembly 125 trips into the borehole 115 (e.g., there is no weight on bit), a load sensor associated with the driveshaft/housing lock system 140, in conjunction with a locking mechanism, locks a relative rotation of a housing associated with the drillstring 130 and the driveshaft 155, thereby transferring torque from the driveshaft 155 to the housing. (The load sensor and locking mechanism are discussed in greater detail below.) This may be in response to the load sensor sensing a compressive force (e.g., among others) between the housing and the driveshaft 155.

In contrast, as the drilling assembly 125 drills through the formation 120 (e.g., there is weight on bit) the driveshaft/housing lock system 140 unlocks (or as the case may be fails to lock) a relative rotation of the housing and driveshaft 155. Accordingly, when there is weight on bit, the housing remains fixed in the formation 120 (e.g., partially by way of the anti-rotation system 135) as the driveshaft 155 rotates therein. Additionally, as the drilling assembly 125 trips out of the borehole 115 (e.g., there is no weight on bit) the load sensor again locks a relative rotation of the housing and driveshaft 155, thereby transferring torque from the driveshaft 155 to the housing. This again may be in response to the load sensor sensing a compressive force (e.g., among others) between the housing and the driveshaft 155.

Figure 2A:
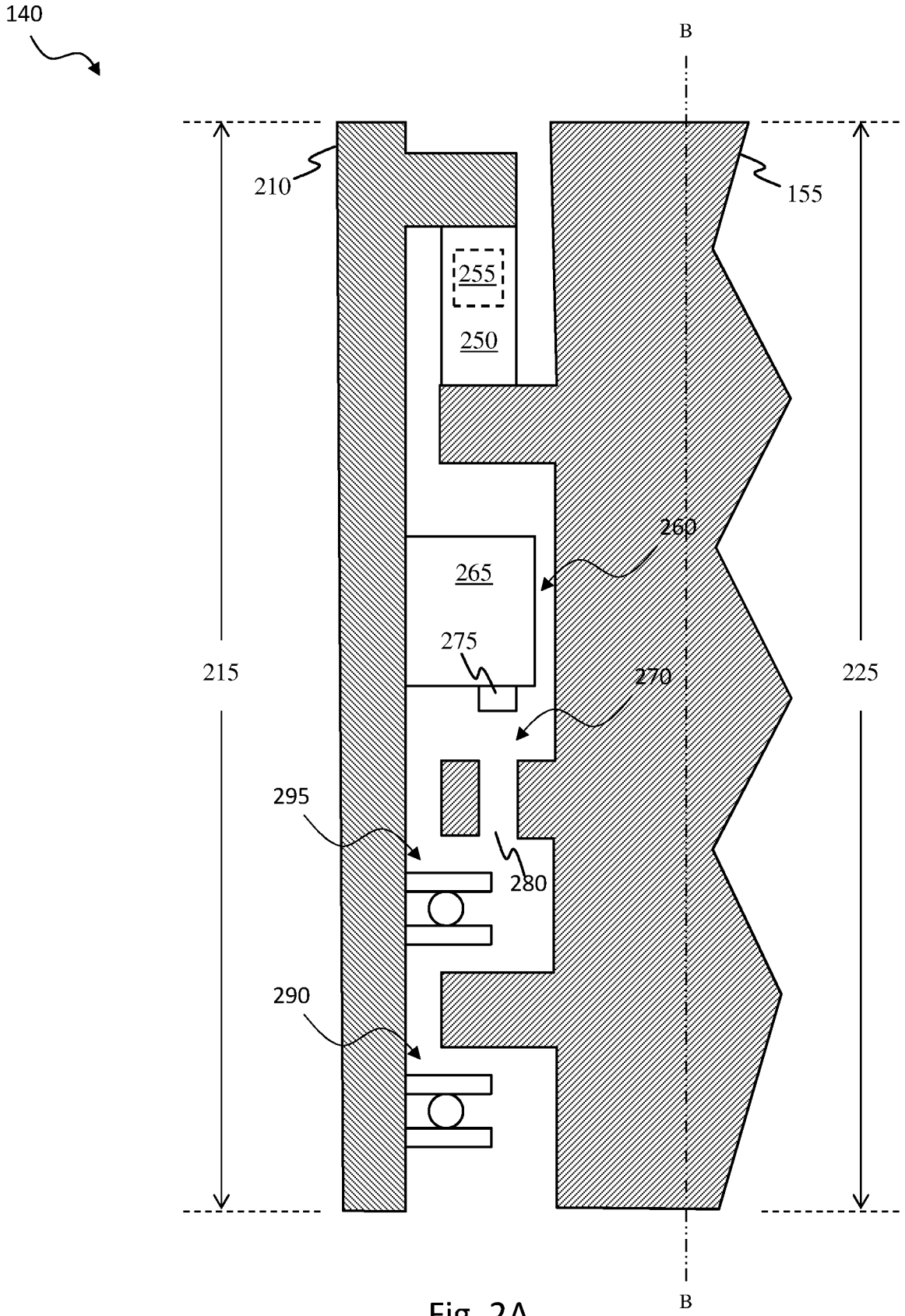
FIG. 2A illustrates a partial sectional view of the driveshaft/housing lock system of FIG. 1 taken through the longitudinal axis B-B.

FIG. 2A illustrates a partial sectional view of the driveshaft/housing lock system 140 taken through the longitudinal axis B-B of FIG. 1. For the purpose of these discussions, the driveshaft/housing lock system 140 is oriented in FIG. 2A as if it were located in the borehole 115 in the formation 120 (FIG. 1), with the top of the driveshaft/housing lock system 140 being more near the surface 110 and the bottom of the driveshaft/housing lock system 140 being more near the bottom of the borehole 130.

The driveshaft/housing lock system 140 of FIG. 2A includes a housing 210 defining a first longitudinal dimension 215. In application, the housing 210 might be a housing of the drillstring 130, among other housings surrounding and protecting the driveshaft 155 from the well formation 120. (FIG. 1) Positioned within the housing 210 of the driveshaft/housing lock system 140 is the driveshaft 155. The driveshaft 155, in the embodiment shown, defines a second longitudinal dimension 225. In application, the driveshaft 155 might couple the surface of the borehole to the drillbit 160 for drilling an oil/gas well.

As is the case in many drillstrings 130 (FIG. 1), the housing 210 and the driveshaft 155 are operable to slide relative to one another along the first longitudinal dimension 215 and the second longitudinal dimension 225. For example, as the drilling operations begin, and there is weight on bit, the driveshaft 155 might slide down (e.g., in the orientation shown) in relation to the housing 210. Similarly, as the drilling operations end, and there is no weight on bit, the driveshaft 155 might slide up (e.g., in the orientation shown) in relation to the housing 210.

The degree of sliding movement between the housing 210 and the driveshaft 155 may vary greatly depending on the tool configuration. For example, in certain embodiments the degree of sliding movement may be as low as about 0.025 mm (or less), yet in certain other embodiments the degree of sliding movement may be as much as about 2.5 mm (or more). Notwithstanding, the present disclosure should not be limited to any specific amount of sliding movement.

As is the case in many drillstrings 130 (FIG. 1), the housing 210 and driveshaft 155 are also operable to rotate relative to one another. In many instances, particularly when drilling, the housing 210 remains fixed (e.g., rotationally speaking) in the formation 120 (FIG. 1) as the driveshaft 155 rotates therein (e.g., about longitudinal axis B-B). The fixed nature of the housing 210 allows for geostationary steering of the drilling process.

The driveshaft/housing lock system 140 illustrated in the embodiment of FIG. 2A further includes a load sensor 250. The load sensor 250, in accordance with the disclosure, is operable to sense the sliding movement between the housing 210 and the driveshaft 155. It is discussed throughout the disclosure that the load sensor 250 is operable to lock or unlock, or locks or unlocks, the relative rotation of the housing 210 and the driveshaft 155 in response to sensing the sliding movement. It should be appreciated that the locking or unlocking of the relative rotation of the housing 210 and the driveshaft 155 by the load sensor 250 may be direct or indirect. For example, in one embodiment the load sensor 250 may (e.g., itself) lock or unlock the relative rotation of the housing 210 and the driveshaft 155. Yet, in another embodiment the load sensor 250 may employ other features (e.g., an actuator) to lock or unlock the relative rotation of the housing 210 and the driveshaft 155. Notwithstanding, the present disclosure should not be limited to the direct or indirect locking or unlocking on the part of the load sensor 250.

In one embodiment of the disclosure, the load sensor 250 might be configured to unlock (or cause to unlock) the relative rotation of the housing 210 and the driveshaft 155 when there is weight on bit. In contrast to this embodiment, the load sensor 250 might be configured to lock (or cause to lock) the relative rotation of the housing 210 and the driveshaft 155 when there is no weight on bit. For example, the load sensor 250 might lock the relative rotation of the housing 210 and the driveshaft 155 when the housing 210 and driveshaft 155 are tripping out of the well. Likewise, the load sensor 250 might lock the relative rotation of the housing 210 and the driveshaft 155 when the housing 210 and driveshaft 155 are tripping into the well. Thus, in one embodiment, the load sensor 250 is designed to lock (or cause to lock) the relative rotation of the housing 210 to the driveshaft 155 at all times other than those instances when it is necessary for the housing 210 to be fixed in the formation 120 (FIG. 1) while the driveshaft 155 rotates therein, such as might be the case when drilling.

In the embodiment shown in FIG. 2A, the load sensor 250 is configured to compress as the drilling assembly 125 (FIG. 1) goes from an orientation of weight on bit to no weight on bit. Thus, in this embodiment, the load sensor 250 locks (or causes to lock) the relative rotation of the housing 210 and the driveshaft 155 based upon this compressive force. Other configurations may exist wherein the load sensor 250 compresses as the drilling assembly 125 (FIG. 1) goes from no weight on bit to weight on bit. In this embodiment, the load sensor 250 might unlock (or cause to unlock) the relative rotation of the housing 210 and the driveshaft 155 based upon this compressive force. Other embodiments may exist wherein the load sensor 250 locks or unlocks the relative rotation of the housing 210 and the driveshaft 155 based upon tension on the load sensor 250. Many different configurations of the load sensor 250, as it relates to the housing 210 and driveshaft 155, may be used and remain within the scope of the present disclosure.

In one particular embodiment, load sensor 250 is configured to lock or unlock (or cause to lock or unlock) the relative rotation of the housing 210 and the driveshaft 155 in an autonomous fashion. The phrase autonomous fashion may mean acting independently, or at least having the freedom to act independently. In this embodiment, no human intervention would be required to lock or unlock the relative rotation of the housing 210 and the driveshaft 155. In fact, in this embodiment, the load sensor 250 might sense an appropriate load, and independently lock or unlock (or cause to lock or unlock) the relative rotation of the housing 210 and the driveshaft 155.

Alternatively, the load sensor 250 might operate in a non-autonomous fashion. For example, the load sensor 250 might sense a load, and having done so send a notice to a human or computer at the surface of the borehole 115 (FIG. 1) via the wireline 190 (FIG. 1). That human or computer could thereafter lock or unlock the relative rotation of the housing 210 and the driveshaft 155 based upon the notice. Yet even other embodiments exist wherein the load sensor 250 operates in a semi-autonomous fashion. In this embodiment, the load sensor 250 might lock and unlock the relative rotation of the housing 210 and driveshaft 155 autonomously, but may be overridden or supplemented, as necessary, by a human or computer at the surface 110 (FIG. 1) of the well.

A variety of different load sensors 250 may be used and remain within the scope of the present disclosure. For example, in the embodiment of FIG. 2A, the load sensor 250 comprises a strain gauge. In this embodiment, the strain gauge would output a strain value as the housing 210 and driveshaft 155 move relative to one another, for example toward one another. For this given embodiment, once the strain value hits a predetermined value, the strain gauge would lock (or cause to lock as it may be), the relative rotation of the housing 210 and the driveshaft 155.

In yet another embodiment, the load sensor 250 could comprise a pressure sensor. In this embodiment, the pressure sensor would output a pressure value as the housing 210 and driveshaft 155 move relative to one another. Again, as the pressure value hits a predetermined value, the pressure sensor could lock (or cause to lock as it may be) the relative rotation of the housing 210 and the driveshaft 155.

In even yet another embodiment, the load sensor 250 could comprise a piezoelectric stack. In this embodiment, the piezoelectric stack would output a voltage as the housing 210 and driveshaft 155 move relative to one another. In this embodiment, once the voltage value hits a predetermined value, the piezoelectric stack would lock (or cause to lock as it may be) the relative rotation of the housing 210 and the driveshaft 155.

In certain embodiments, particularly when the load sensor 250 is a piezoelectric stack, a capacitor 255 could be coupled to the load sensor 250. The capacitor 255, in this embodiment, could be configured to charge when the piezoelectric stack generates voltages below a predetermined value, such as might be generated as a result of operational vibrations between the housing 210 and the driveshaft 155 (e.g., bit bounce). Likewise, the capacitor 255 could be configured to discharge to lock or unlock the relative rotation of the housing 210 and the driveshaft 155 when the piezoelectric stack generates voltages above the predetermined value, such as might be generated as a result of the housing 210 and driveshaft 155 tripping out of or into the well. Thus, the capacitor 255 in this embodiment could provide a self-contained power source.

While a collection of different types of load sensors 250 have been discussed herein, the present disclosure should not be limited to such load sensors 250. In fact, any load sensor 250 capable of sensing the sliding movement between the housing 210 and driveshaft 155, and based thereon locking (or unlocking) the relative rotation of the housing 210 and the driveshaft 155, is within the scope of the present disclosure.

The load sensor 250 can employ a variety of different locking mechanisms 260 for locking and unlocking (e.g., indirectly locking) the relative rotation between the housing 210 and the driveshaft 155 (e.g., in response to the load sensor 250 sensing the housing and driveshaft sliding relative to one another). For example, in the embodiment of FIG. 2A the locking mechanisms 260 collectively employs an actuator 265 and a torque coupling assembly 270 to lock or unlock the relative rotation of the housing 210 and the driveshaft 155.

Various different actuators 265 may be used and remain within the purview of the disclosure. In one embodiment, such as shown in FIG. 2A, the actuator 265 comprises a hydraulic piston. In other embodiments, the actuator 265 might comprise a pneumatic piston, solenoid, ball screw, etc., among others. It should be understood that any known or hereafter discovered actuator 265 may be used, so long as it is capable of assisting the load sensor 250 in locking or unlocking the relative rotation of the housing 210 and the driveshaft 155. In such embodiments, the actuators 265 may be configured as linear actuators, as shown in FIG. 2A, or radial actuators (not shown).

The load sensor 250 and locking mechanism 260 may communicate in a variety of different ways. In certain instances, for example, the load sensor 250 simply sends an electrical signal to the actuator 265 to actuate. In other instances, the load sensor 250 trips a pneumatic or hydraulic switch to actuate the actuator 265. In yet other embodiments, the load sensor 250 and the actuator 265 are in fluid (e.g., pneumatic or hydraulic) communication with one another, and the compression of the load sensor 250 creates a pressure that is directly fed to the actuator 265. Many other configurations, outside of these few discussed, are within the scope of the present disclosure.

The actuators 265, in accordance with the disclosure, could employ a variety of different torque coupling assemblies 270 to lock or unlock the relative rotation of the housing 210 and the driveshaft 155. In the embodiment of FIG. 2A, the torque coupling assembly 270 employs one or more pins 275 that are operable to extend from the actuator 265 into one or more slots 280 in the driveshaft 155. As the one or more pins 275 extend into the one or more slots 280, the housing 210 and driveshaft 155 become rotationally locked.

Other torque coupling assemblies 270 may, nonetheless, be used and remain within the scope of the disclosure. For example, in another embodiment, the torque coupling assembly 270 employs one or more collections of gears to lock or unlock the relative rotation of the housing 210 and the driveshaft 155. In yet another embodiment, the torque coupling assembly 270 employs one or more collections of keys to lock or unlock the relative rotation of the housing 210 and the driveshaft 155.

In another embodiment consistent with the disclosure, the torque coupling assembly 270 employs friction to lock or unlock the relative rotation of the housing 210 and the driveshaft 155. For example, the torque coupling assembly 270 may use one or more of a collection of clutches, thrust plates, tapered cones, etc., to generate enough internal friction between the housing 210 and the driveshaft 155 to overcome any external friction that may exist between the housing 210 and the formation 120 (FIG. 1). Once the internal friction value exceeds the external friction value, the relative rotation of the housing 210 and the driveshaft 155 would ideally lock.

The driveshaft/housing lock system 140 illustrated in the embodiment of FIG. 2A further includes an on-bottom bearing 290 and an off-bottom bearing 295. In the embodiment shown, the on-bottom bearing 290 provides a low friction surface for the driveshaft 155 to rotate within the housing 210. Further to the embodiment shown, the off-bottom bearing 295 provides a stop point for sliding movement between the driveshaft 155 and housing 210 as the drilling assembly 125 (FIG. 1) is tripping out of or into the borehole. While it has been illustrated in FIG. 2A that bearings are used, other embodiments exist wherein bushings are used, or alternatively a combination of bushings and bearings are used. Even yet other embodiments exist where no bearings or bushing are used at all. Accordingly, the present disclosure should not be limited to any particular bearing or bushing, or even their existence at all.

The driveshaft/housing lock system 140 of FIG. 2A can be configured to work as an independent system, or alternatively could be connected to the tools main communication bus. For a fully independent driveshaft/housing lock system 140, power could be supplied by on-board batteries or the above mentioned capacitor 255. In this embodiment, the load sensor 250 and actuator 265 would not need to be connected to the tool's main communication bus. Other embodiments exist wherein the actuator 265 taps into existing pressure sources for actuation thereof, including hydraulic systems already existing downhole in the tool.

Figure 2B:
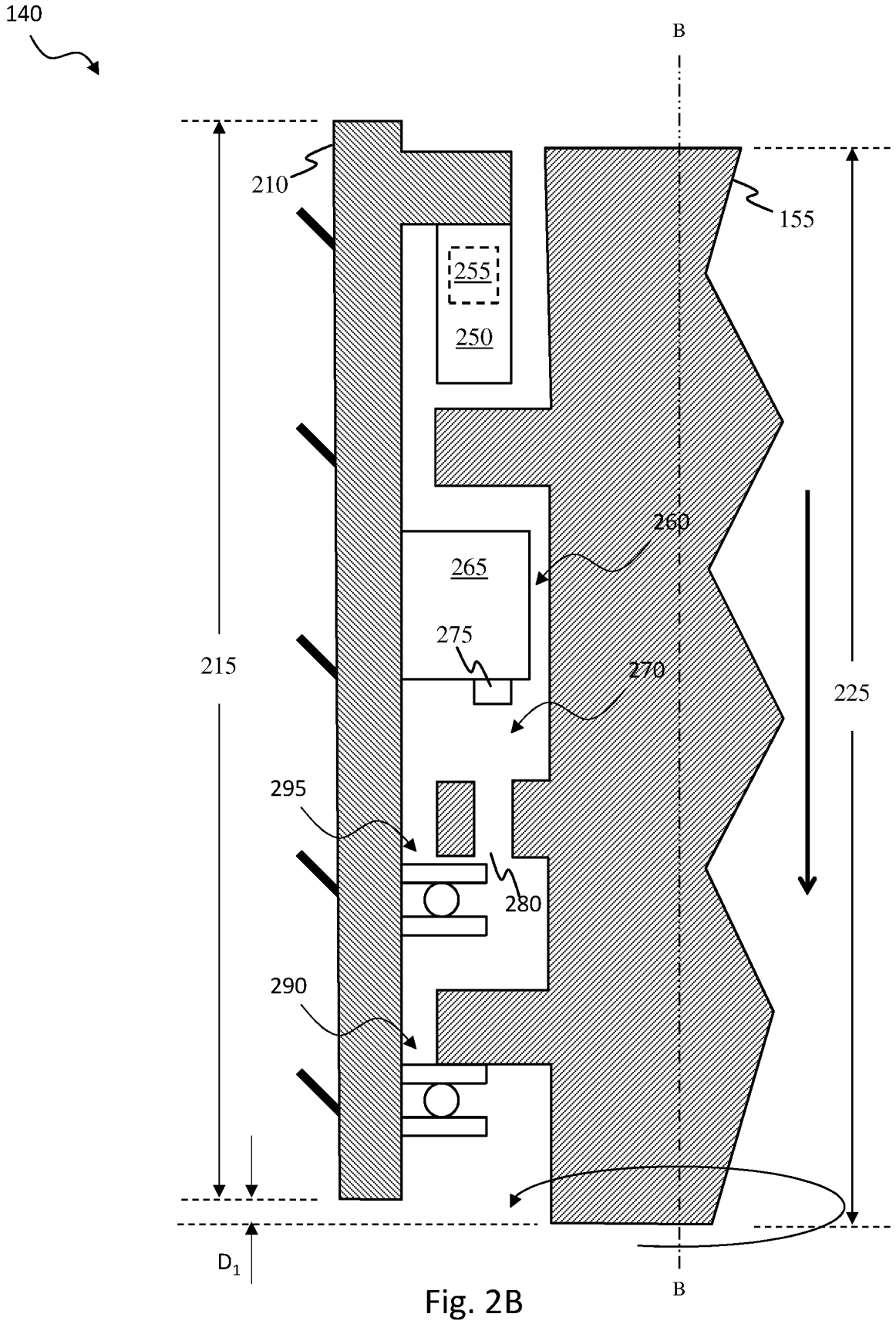
FIG. 2B illustrates a partial sectional view of the driveshaft/housing lock system of FIG. 2A with weight on bit.

FIG. 2B illustrates a partial sectional view of the driveshaft/housing lock system 140 of FIG. 2A with weight on bit (e.g., as shown by the large downward facing arrow). FIG. 2B illustrates the driveshaft 155, relatively speaking, lower than the housing 210 by a distance ($D_1$), as might occur when there is weight on bit. In this embodiment, as the driveshaft 155 slides down with respect to the housing 210, the load sensor 250 does not sense a load. Accordingly, the load sensor 250 does not lock (or cause to lock) the relative rotation of the housing 210 and the drive shaft 155. Thus, in this particular use-based situation (e.g., weight is on bit) the housing 210 is fixed (rotationally speaking) within the formation 120 (FIG. 1), and the driveshaft 155 is free to rotate within the housing 210.

Figure 2C:
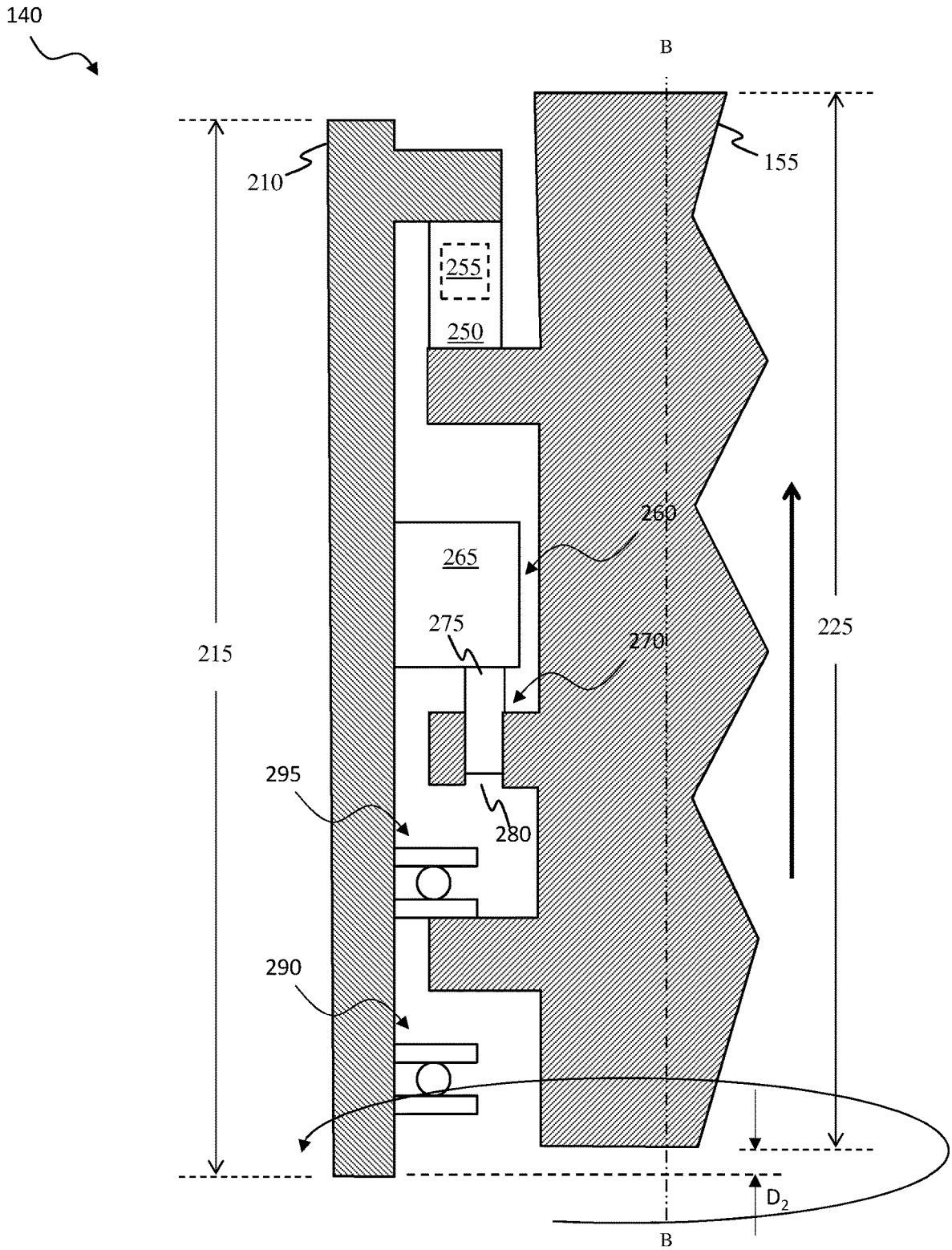
FIG. 2C illustrates a partial sectional view of the driveshaft/housing lock system of FIG. 2A with no weight on bit.

FIG. 2C illustrates a partial sectional view of the driveshaft/housing lock system 140 of FIG. 2A with no weight on bit (e.g., as shown by the large upward facing arrow). For example, the driveshaft/housing lock system 140 of FIG. 2C is illustrative of an example where the driveshaft/housing lock system 140 is tripping out of or tripping into the hole. FIG. 2C illustrates the driveshaft 155, relatively speaking, higher than the housing 210 by a distance ($D_2$), as might occur when there is no weight on bit. As shown in FIG. 2C, as the driveshaft 155 slides up with respect to the housing 210, the load sensor 250 senses a load (e.g., a compressive force in this embodiment). In turn, the load sensor 250 signals the actuator 265 to cause the one or more pins 275 and one or more slots 280 of the torque coupling assembly 270 to engage each other. In doing so, a relative rotation of the housing 210 and driveshaft 155 locks, and the housing 210 and driveshaft 155 rotate in unison about the longitudinal axis B-B.

Figure 3A:
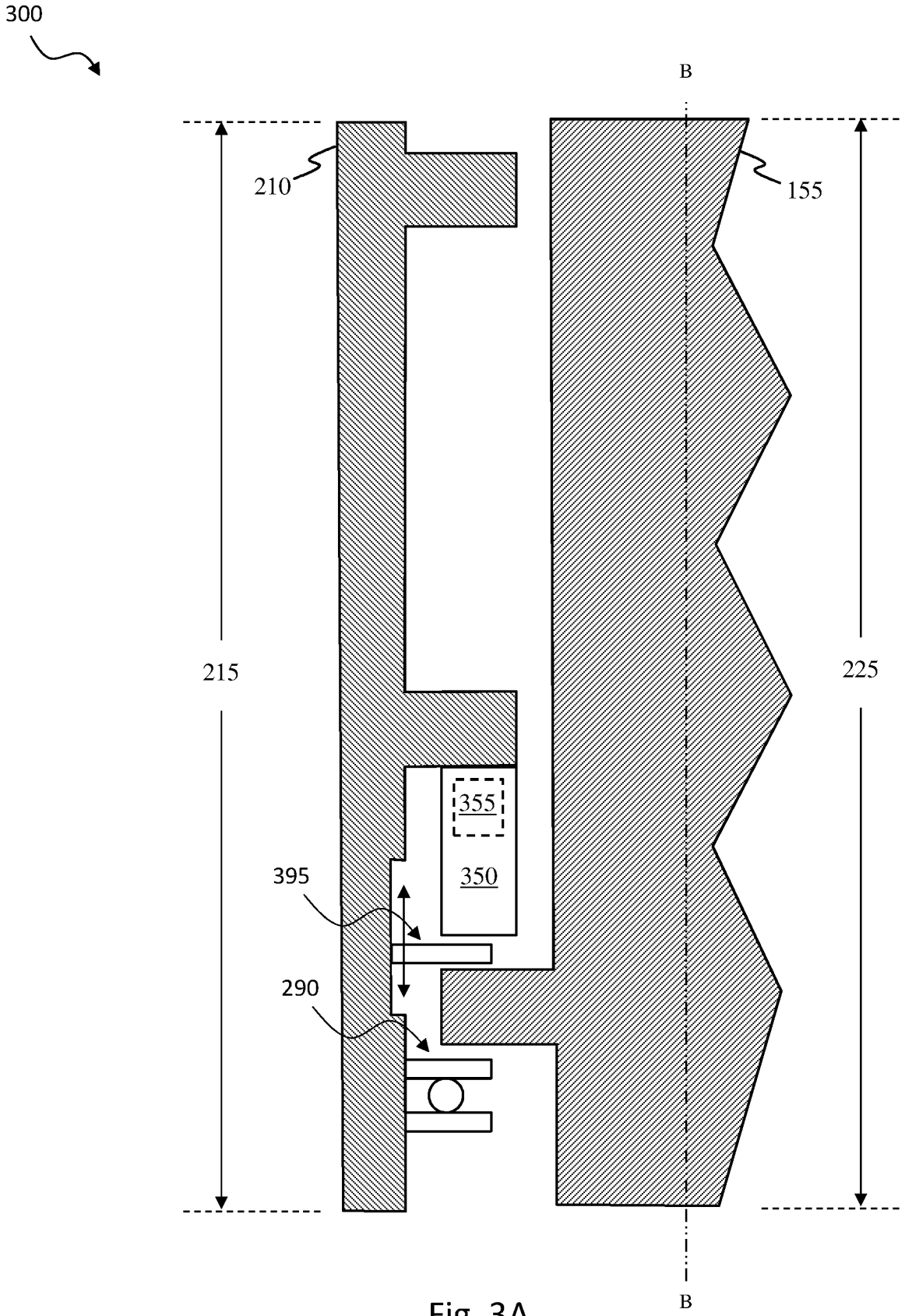
FIG. 3A illustrates is a partial sectional view of an alternative embodiment of a driveshaft/housing lock system provided in accordance with the disclosure.

Turning to FIG. 3A, illustrated is a partial sectional view of an alternative embodiment of a driveshaft/housing lock system 300 provided in accordance with the disclosure. For the purpose of these discussions, the driveshaft/housing lock system 300 is oriented in FIG. 3A as if it were located in a borehole 115 (FIG. 1) in a formation 120 (FIG. 1), with the top of the driveshaft/housing lock system 300 being more near the surface 110 (FIG. 1) and the bottom of the driveshaft/housing lock system 300 being more near the bottom of the borehole 115 (FIG. 1).

The driveshaft/housing lock system 300 is similar in many respects to the driveshaft/housing lock system 140 illustrated in FIG. 2A. For example, the driveshaft/housing lock system 300 could include the housing 210 and first longitudinal dimension 215, as well as the driveshaft 155 and second longitudinal dimension 225. The driveshaft/housing lock system 300 could additionally include the on-bottom bearing 290, among other common features.

The driveshaft/housing lock system 300 of FIG. 3A differs, however, from the driveshaft/housing lock system 140 of FIG. 2A in certain respects. First, the driveshaft/housing lock system 300 of FIG. 3A employs a longitudinally sliding bushing 395 in place of the off-bottom bearing 295. In this embodiment, the longitudinally sliding bushing 395 accommodates the sliding movement between the housing 210 and the driveshaft 155.

Additionally, the driveshaft/housing lock system 300 employs a combined load sensor and locking mechanism (e.g., illustrated as load sensor/actuator 350), as opposed to the separate load sensor 250 and locking mechanism 260. In the embodiment of FIG. 3A, the combined load sensor/actuator 350 comprises a piezoelectric stack. Notwithstanding, the combined load sensor/actuator 350 may comprise other structures (e.g., a hydraulic actuator) and remain within the scope of the present disclosure. The driveshaft/housing lock system 300 of FIG. 3A additionally employs a voltage reversing circuit 355.

Figure 3B:
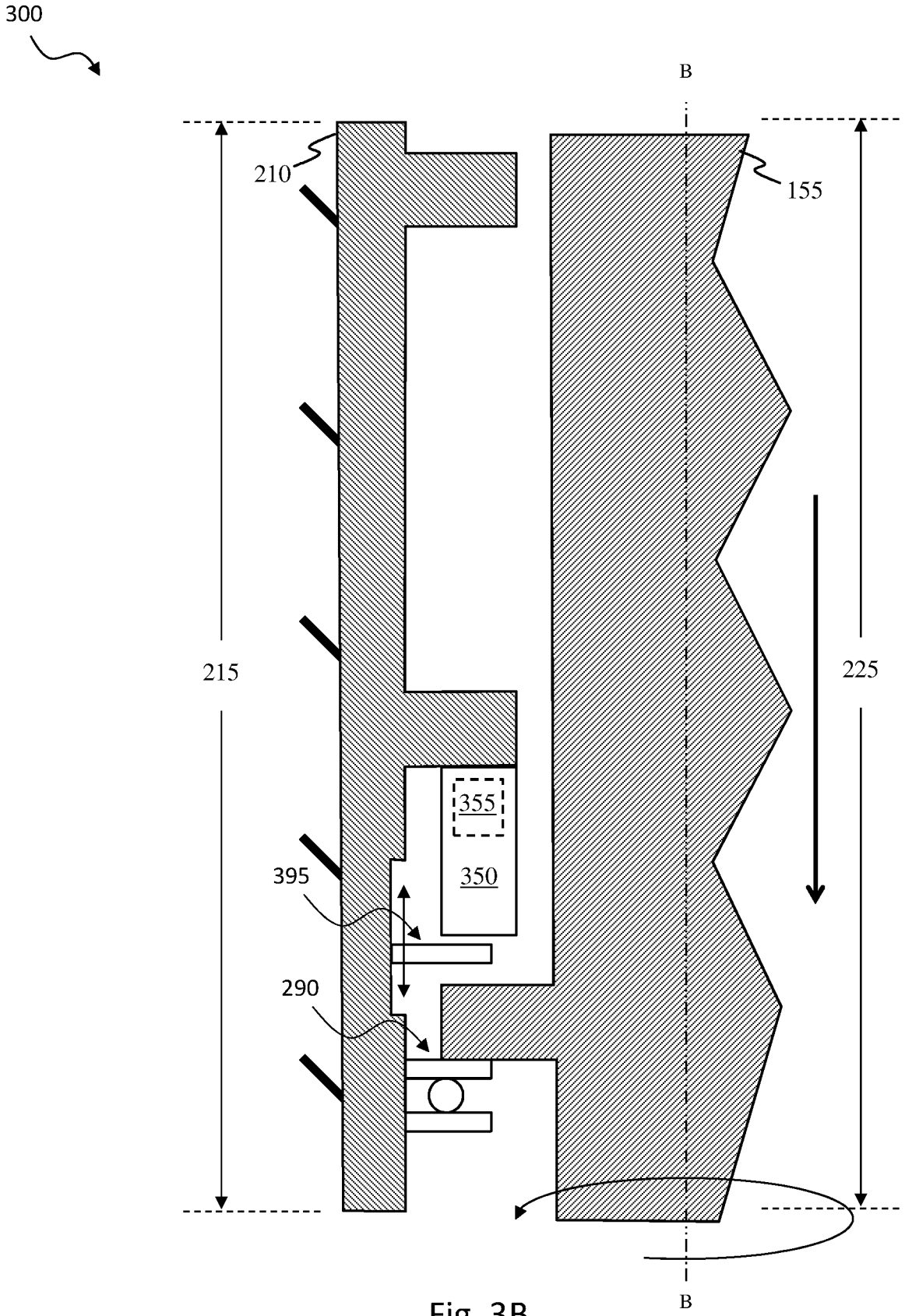
FIG. 3B illustrates a partial sectional view of the driveshaft/housing lock system of FIG. 3A with weight on bit.

FIG. 3B illustrates a partial sectional view of the driveshaft/housing lock system 300 of FIG. 3A with weight on bit (e.g., as shown by the large downward facing arrow). In this embodiment, as the driveshaft 155 slides down with respect to the housing 210, the combined load sensor/actuator 350 does not sense a load. Accordingly, the combined load sensor/actuator 350 does not lock (or cause to lock) the relative rotation of the housing 210 and the drive shaft 155. Thus, in this particular use-based situation (e.g., weight is on bit) the housing 210 is fixed (rotationally speaking) within the formation, and the driveshaft 155 is free to rotate.

Figure 3C:
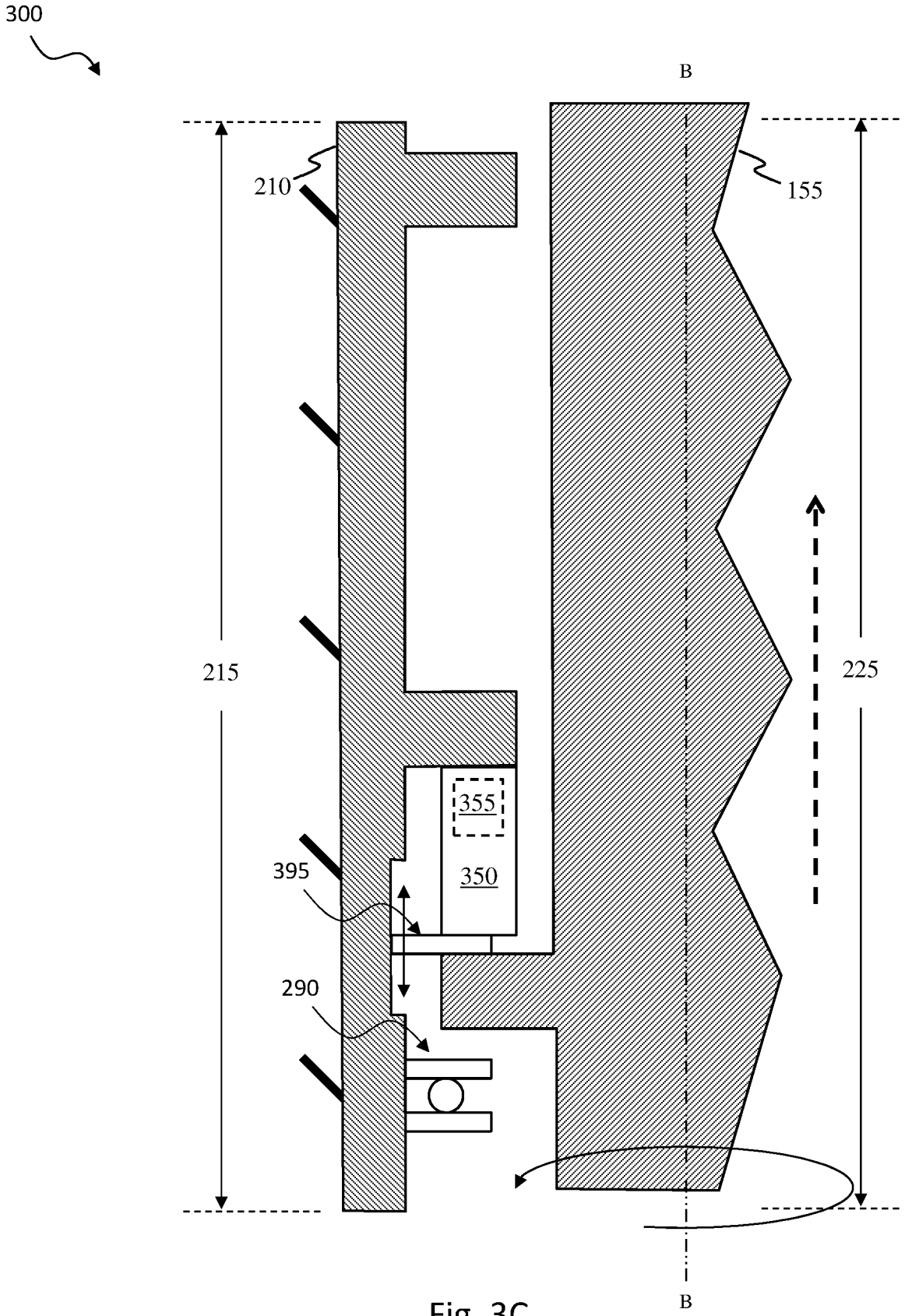
FIG. 3C illustrates a partial sectional view of the driveshaft/housing lock system of FIG. 3B at the moment there is no weight on bit.

FIG. 3C illustrates a partial sectional view of the driveshaft/housing lock system 300 of FIG. 3B at the moment there is no weight on bit (e.g., as shown by the large dashed upward facing arrow). Such a configuration is consistent with the moment that the tool transitions from weight on bit to no weight on bit. For example, the driveshaft/housing lock system 300 of FIG. 3C is illustrative of an example where the driveshaft/housing lock system 300 is just beginning to trip out of or trip into the borehole 115 (FIG. 1). As shown in FIG. 3C, as the driveshaft 155 slides up with respect to the housing 210 it presses the longitudinally sliding bushing 395 against the combined load sensor/actuator 350. Accordingly, the combined load sensor/actuator 350 senses a load (e.g., a compressive force in this embodiment). In turn, the combined load sensor/actuator 350 generates a first voltage.

Figure 3D:
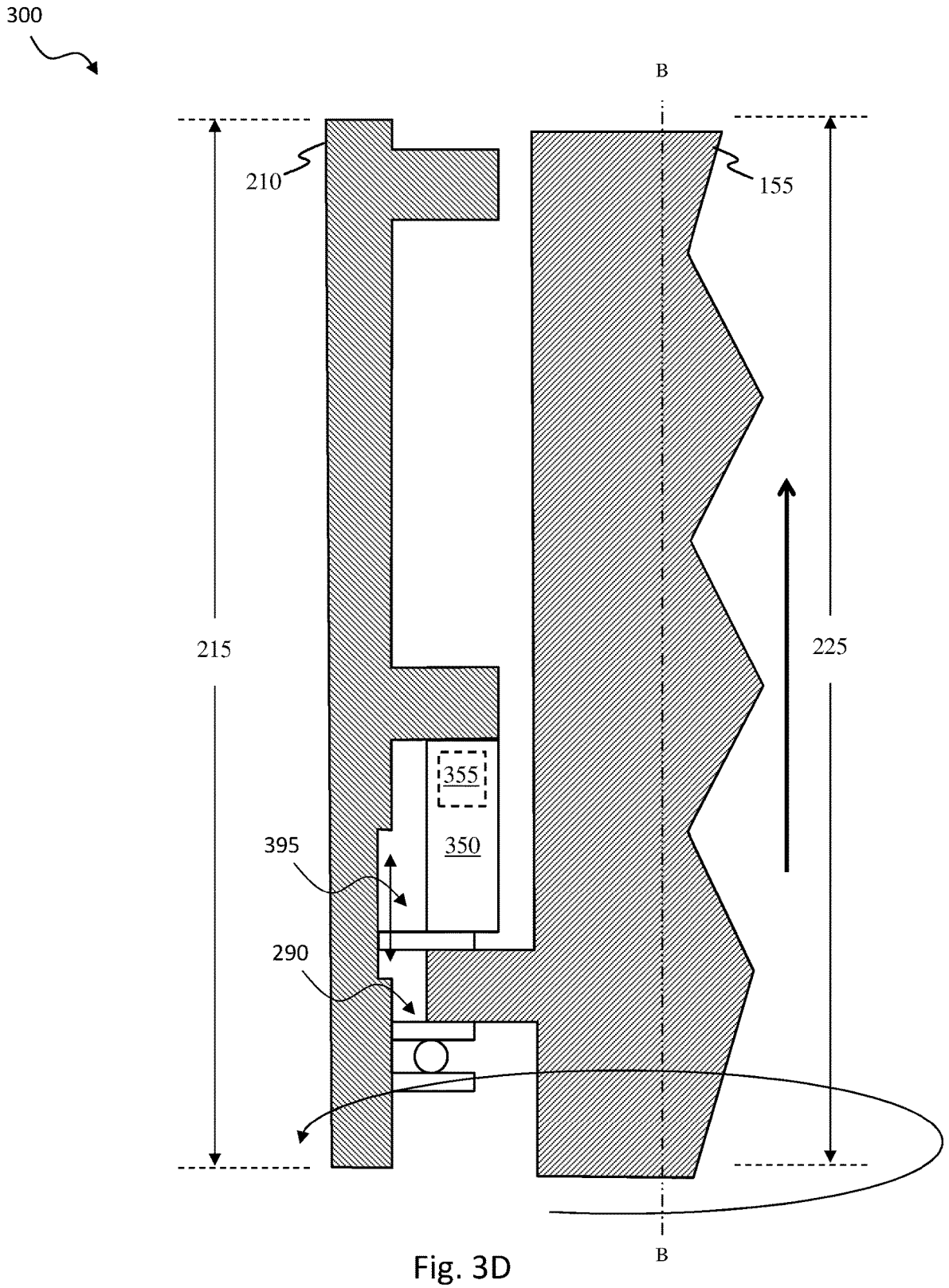
FIG. 3D illustrates a partial sectional view of the driveshaft/housing lock system of FIG. 3C a few moments after the weight on bit is removed.

FIG. 3D illustrates a partial sectional view of the driveshaft/housing lock system 300 of FIG. 3C a few moments after the weight on bit is removed (e.g., as shown by the large solid upward facing arrow). Such a configuration is consistent with the moment after the first voltage is fed to the voltage reversing circuit 355. In this use-based situation, the voltage reversing circuit 355 generates a second larger opposite voltage, and applies the second larger opposite voltage to the piezoelectric stack. The second larger opposite voltage generates a net positive displacement in the piezoelectric stack, which in turn pushes back against the longitudinally sliding bushing 395, thereby trapping the driveshaft 155 between the longitudinally sliding bushing 395 and the on-bottom bearing 290. The phrase net positive displacement may require that the distance of physical compression of the combined load sensor/actuator 350 in response to the tool tripping into or out of the borehole is less than the extension of the combined load sensor/actuator 350 caused by the second larger opposite voltage. Thus, the collective friction between the driveshaft 155 and longitudinally sliding bushing 395, and driveshaft 155 and on-bottom bearing 290, locks the relative rotation of the housing 210 and the driveshaft 155.

Embodiments disclosed herein include:

A. A drilling system, including a housing defining a first longitudinal dimension, and a driveshaft positioned within the housing and defining a second longitudinal dimension, wherein the housing and driveshaft are operable to slide relative to one another along the first longitudinal dimension and the second longitudinal dimension, and rotate relative to one another, a load sensor operable to sense the housing and driveshaft sliding relative to one another, and a locking mechanism operable to lock or unlock the relative rotation of the housing and the driveshaft in response to the load sensor sensing the housing and driveshaft sliding relative to one another thereto.

B. A method of operating a downhole tool, including tripping a steerable/rotational tool into or out of a well. The steerable/rotational tool, in this embodiment includes a driveshaft/housing lock system, which further includes a housing defining a first longitudinal dimension, a driveshaft positioned within the housing and defining a second longitudinal dimension, wherein the housing and driveshaft are operable to slide relative to one another along the first longitudinal dimension and the second longitudinal dimension, and rotate relative to one another, and a load sensor positioned between the housing and driveshaft. The method further includes locking and unlocking the relative rotation of the housing and the driveshaft based upon an output of the load sensor.

Each of the foregoing embodiments may comprise one or more of the following additional elements singly or in combination, and neither the example embodiments or the following listed elements limit the disclosure, but are provided as examples of the various embodiments covered by the disclosure:

Element 1: wherein the load sensor is positioned between the housing and driveshaft, the load sensor operable to generate a signal in response to sensing the housing and driveshaft sliding relative to one another, and further wherein the locking mechanism is operable to lock or unlock the relative rotation of the housing and the driveshaft in response to receiving the signal. Element 2: wherein the locking mechanism locks the relative rotation of the housing and the driveshaft as the housing and driveshaft are tripping out of a well, but allows the driveshaft to rotate within the housing when there is weight on bit. Element 3: wherein the load sensor locks the relative rotation of the housing and the driveshaft as it senses a compressive force. Element 4: wherein the load sensor employs an actuator and a torque coupling assembly to lock or unlock the relative rotation of the housing and the driveshaft. Element 5: wherein the torque coupling assembly employs one or more pins, gears, or keys to lock or unlock the relative rotation of the housing and the driveshaft. Element 6: wherein the torque coupling assembly employs friction to lock or unlock the relative rotation of the housing and the driveshaft. Element 7: wherein the friction is created using one or more of clutches, thrust plates or tapered cones. Element 8: wherein the actuator is a linear actuator. Element 9: wherein the actuator is a solenoid, hydraulic piston, pneumatic piston or ball screw. Element 10: wherein a piezoelectric stack functions as both the load sensor and the actuator. Element 11: wherein the piezoelectric stack is operable to generate a first voltage when it senses a compressive force as a result of the sliding movement. Element 12: wherein the first voltage is operable to be fed to a voltage reversing circuit, which in turn is operable to apply a second larger opposite voltage to the piezoelectric stack to generate a net positive displacement in the piezoelectric stack to lock the relative rotation of the housing and the driveshaft. Element 13: wherein the load sensor is a piezoelectric stack, strain gauge or pressure sensor. Element 14: wherein the load sensor is a piezoelectric stack coupled to a capacitor, the capacitor operable to charge when the piezoelectric stack generates voltages below a predetermined value, and operable to discharge to lock the relative rotation of the housing and the driveshaft when the piezoelectric stack generates voltages above the predetermined value. Element 15: wherein the piezoelectric stack is operable to sense vibrations between the housing and driveshaft to charge the capacitor. Element 16: wherein the load sensor is positioned between the housing and driveshaft. Element 17: further including locking or unlocking the relative rotation of the housing and the driveshaft in an autonomous fashion. Element 18: further including locking the relative rotation of the housing and the driveshaft as the housing and driveshaft are tripping out of the well, and unlocking the relative rotation of the housing and the driveshaft as there is weight on bit. Element 19: further including locking and unlocking the relative rotation of the housing and the driveshaft as the load sensor senses a compressive force.

The foregoing listed embodiments and elements do not limit the disclosure to just those listed above.

Those skilled in the art to which this application relates will appreciate that other and further additions, deletions, substitutions and modifications may be made to the described embodiments.

What is claimed is:

1. A drilling system, comprising:

a housing defining a first longitudinal dimension;

a driveshaft positioned within the housing and defining a second longitudinal dimension, wherein the housing and driveshaft are operable to slide relative to one another along the first longitudinal dimension and the second longitudinal dimension, and rotate relative to one another;

a load sensor operable to sense the housing and driveshaft sliding relative to one another; and a locking mechanism operable to lock or unlock the relative rotation of the housing and the driveshaft in response to the load sensor sensing the housing and driveshaft sliding relative to one another thereto.

2. The drilling system as recited in claim 1, wherein the load sensor is positioned between the housing and driveshaft, the load sensor operable to generate a signal in response to sensing the housing and driveshaft sliding relative to one another, and further wherein the locking mechanism is operable to lock or unlock the relative rotation of the housing and the driveshaft in response to receiving the signal.

3. The drilling system as recited in claim 1, wherein the locking mechanism locks the relative rotation of the housing and the driveshaft as the housing and driveshaft are tripping out of a well, but allows the driveshaft to rotate within the housing when there is weight on bit.

4. The drilling system as recited in claim 1, wherein the load sensor is operable to sense a compressive force.

5. The drilling system as recited in claim 1, wherein the locking mechanism employs an actuator and a torque coupling assembly to lock or unlock the relative rotation of the housing and the driveshaft.

6. The drilling system as recited in claim 5, wherein the torque coupling assembly employs one or more pins or keys to lock or unlock the relative rotation of the housing and the driveshaft.

7. The drilling system as recited in claim 5, wherein the torque coupling assembly employs friction to lock or unlock the relative rotation of the housing and the driveshaft.

8. The drilling system as recited in claim 7, wherein the friction is created using one or more of clutches, thrust plates or tapered cones.

9. The drilling system as recited in claim 5, wherein the actuator is a linear actuator.

10. The drilling system as recited in claim 5, wherein the actuator is a solenoid, hydraulic piston, pneumatic piston or ball screw.

11. The drilling system as recited in claim 5, wherein the load sensor and the actuator are combined as a piezoelectric stack.

12. The drilling system as recited in claim 11, wherein the piezoelectric stack is operable to generate a first voltage when it senses a compressive force as a result of the housing and driveshaft sliding relative to one another.

13. The drilling system as recited in claim 12, wherein the first voltage is operable to be fed to a voltage reversing circuit, which in turn is operable to apply a second larger opposite voltage to the piezoelectric stack to generate a net positive displacement in the piezoelectric stack to lock the relative rotation of the housing and the driveshaft.

14. The drilling system as recited in claim 1, wherein the load sensor is a piezoelectric stack, strain gauge or pressure sensor.

15. The drilling system as recited in claim 14, wherein the load sensor is a piezoelectric stack coupled to a capacitor, the capacitor operable to charge when the piezoelectric stack generates voltages below a predetermined value, and operable to discharge to lock the relative rotation of the housing and the driveshaft when the piezoelectric stack generates voltages above the predetermined value.

16. The drilling system as recited in claim 15, wherein the piezoelectric stack is operable to sense vibrations between the housing and driveshaft to charge the capacitor.

17. A method of operating a drilling system, comprising:

tripping a drilling system into or out of a well, wherein the drilling system includes;

a housing defining a first longitudinal dimension;

a driveshaft positioned within the housing and defining a second longitudinal dimension, wherein the housing and driveshaft are operable to slide relative to one another along the first longitudinal dimension and the second longitudinal dimension, and rotate relative to one another; and a load sensor operable to sense the housing and driveshaft sliding relative to one another; and a locking mechanism operable to lock or unlock the relative rotation of the housing and the driveshaft in response to the load sensor sensing the housing and driveshaft sliding relative to one another thereto; and locking and unlocking the relative rotation of the housing and the driveshaft based upon an output of the load sensor.

18. The method as recited in claim 17, further including locking or unlocking the relative rotation of the housing and the driveshaft in an autonomous fashion.

19. The method as recited in claim 17, further including locking the relative rotation of the housing and the driveshaft as the housing and driveshaft are tripping out of the well, and unlocking the relative rotation of the housing and the driveshaft as there is weight on bit.

20. The method as recited in claim 17, further including locking and unlocking the relative rotation of the housing and the driveshaft as the load sensor senses a compressive force.

* * * * *